United States Patent [19]

Junger et al.

[11] Patent Number: 4,562,901

[45] Date of Patent: Jan. 7, 1986

[54] SOUND ABSORPTIVE STRUCTURAL BLOCK WITH SEQUENCED CAVITIES

[75] Inventors: Miguel C. Junger, 90 Fletcher Rd., Belmont, Mass. 02178; Klaus Kleinschmidt, Lexington, Mass.

[73] Assignee: Miguel C. Junger, Belmont, Mass.

[21] Appl. No.: 541,019

[22] Filed: Oct. 12, 1983

[51] Int. Cl.[4] ..... E04B 1/00; E04B 5/52

[52] U.S. Cl. ..... 181/285; 181/286; 181/288

[58] Field of Search ..... 181/285, 286, 288, 292, 181/293, 295

[56] References Cited

U.S. PATENT DOCUMENTS

| | | | |
|---|---|---|---|
| 2,281,121 | 4/1942 | Straight | 181/285 |
| 2,933,146 | 4/1960 | Zaldastani et al. | 181/285 X |
| 3,506,089 | 4/1970 | Junger | 181/285 |
| 3,837,426 | 9/1974 | Kleinschmidt | 181/285 |
| 3,866,001 | 2/1975 | Kleinschmidt et al. | 181/285 |

OTHER PUBLICATIONS

Handbook for Industrial Noise Control Prepared by Bionetics Corp. for NASA Technology Transfer Division, Langley Research Center, Hampton, Va. (1981) on p. 48, figure 5.5.

*Primary Examiner*—Russell E. Adams
*Assistant Examiner*—Brian W. Brown
*Attorney, Agent, or Firm*—Kenway & Jenney

[57] ABSTRACT

A sound absorbing block of molded structural material has a sequence of internal cavities that communicate with a region containing the sound to be suppressed through a first elongated slot located in an exterior wall of the block. The internal cavities are defined by interior walls, at least one of which also contains an elongated, sound-communicating slot. Each slot and its associated cavity define an acoustical Helmholtz resonator that dissipates sound energy incident upon the slot with an absorption peak at a natural frequency $f_n$. The value of $f_n$ for each resonator is inversely proportional the square root of the volume of the cavity. The internal cavities are arranged to cascade in order of decreasing stiffness beginning at the first slot. In one form, two sequences of cavities in a block use a common final cavity. Also, the exterior slots can be formed in more than one wall to absorb sound produced in multiple regions.

11 Claims, 8 Drawing Figures

SOUND ABSORPTIVE STRUCTURAL BLOCK WITH SEQUENCED CAVITIES

BACKGROUND OF THE INVENTION

This invention relates to a structural block having sound absorbing properties, and more specifically to a sound absorbing block of molded structural material of the general type described in U.S. Pat. Nos. 2,933,146 and 3,886,001, but with a cascaded series of internal cavities connected by internal slots to produce multiple sound absorption peaks at preselected frequency values.

U.S. Pat. No. 2,933,146 to Zaldastani and one of the present applicants describes the broad concept of forming structures such as load-bearing walls and ceilings of buildings with blocks made from a molded aggregate material such as concrete where the blocks have one or more internal cavities that communicate with a noise source through one or more substantially parallel-sided slots. Sound energy is dissipated principally by a Helmholtz resonance effect and a "block body" effect resulting from multiple reflections within the cavity. Some dissipation may be due to a resonant absorptive effect in the "tube" of air running from the slot to the back wall of the associated cavity. The Helmholtz resonator effect can be analogized to a spring-mass system where the mass is the entrained air in the slot and the spring is the air in the much larger volume of the cavity. As with any Helmholtz resonator, this acoustical resonator has a natural frequency $f_n$ at which the absorption of sound energy is maximized.

U.S. Pat. No. 3,506,089 to the present applicant and U.S. Pat. No. 3,837,426 describe improvements on the basic concept of the '146 patent. In these later patents, the configuration of the slot is designed to decrease impedance mismatching of the Helmholtz resonator and to raise the natural frequency above that achieved with a slot having a maximum dimension of the throat section alone. The '089 patent describes a first effort where the slot, instead of being parallel sided, has an outwardly flared configuration. The '426 patent describes another slot configuration, one that is inwardly flared. It also provides improved high frequency response, but also provides significant other advantages in both its structural strength (for a given natural frequency) and use. All of these designs shown in the '146, '089 and '426 patents use one externally communicating slot in association with one internal cavity to produce a resonator with one natural absorption peak, even though a single block may contain multiple such resonators.

U.S. Pat. No. 3,866,001 discloses yet a further improvement where a septum, usually a thin metallic sheet, is placed in the cavity. The septum exhibits a differential sound transmission, reflecting high frequency sounds within a "front" volume and transmitting lower frequencies sounds to a "rear" volume remote from the associated slot. Incident sound energy, depending on its frequency, "sees" two cavities with different volumes. This effect results in two or more absorption peaks for each cavity, depending on the number of septa used. Varying the location of the septum, or septa, within a cavity provides an ability to tune the frequency response to achieve absorption peaks at or near desired values.

While these inventions have generally proven to be commercially successful, there are nevertheless certain disadvantages associated with the use of septa. Metallic septa are themselves costly and they must be inserted manually into each cavity, thereby increasing the labor cost associated with manufacture. In some embodiments septa are bonded to fibrous filler material and inserted together in a cavity. This approach involves the material cost of the filler and its septum and still requires a separate assembly procedure to fit the septum-filler insert into the cavity.

It is therefore a principal object of this invention to provide a sound absorbing structural block that can achieve multiple resonance absorption peaks at preselected values, but does not utilize a metallic septum or an equivalent structure.

Another object is to provide a sound absorbing block with the foregoing advantage that can be formed using only conventional molding procedures for forming concrete blocks.

A further object of this invention is to provide such a block that can also absorb sound energy incident upon both its front and back walls.

Yet another object is to provide a sound absorbing structural block with the foregoing advantages that is compatible with the improvement inventions of U.S. Pat. Nos. 3,506,089; 3,837,426; and 3,866,001.

Still another object is to provide a sound absorbing structural block that is readily manufactured and has a favorable cost of manufacture as compared to prior art blocks with equivalent performance characteristics.

SUMMARY OF THE INVENTION

A sound absorbing block of molded structural material has a generally rectangular, open bottom configuration with top, end, front and rear side walls molded integrally with one another. At least one of the front and rear side walls, those which normally face the sound energy to be suppressed, contain openings, preferably elongated slots, that communicate between the exterior surface of the block and an interior cavity. The slot and cavity form an acoustical Helmholtz resonator with a natural frequency $f_1$ related to the cross-sectional area A of the slot and the volume V of the adjacent internal cavity.

Interior walls molded integrally with and adjoining exterior walls of the block divide the interior space of the block into a plurality of cavities, at leat two of which are associated with each "exterior" slot in the block in a sequenced or series configuration. Interior slots formed in at least one of the interior walls acoustically couple each cavity in a sequence. The volume of the cavities in a sequence increases progressively from the "first" cavity adjacent the exterior slot. The first slot-cavity pair in the series therefore has a natural frequency $f_1$ which is greater than the natural frequency $f_2$ of the first interior slot and its associated "second" cavity. If the block has additional cavities, then $f_n > f_{n+1}$, where n is the order of the cavity in the sequence.

In one form, a standard two cavity block (with a solid, continuous, central partition wall extending from the front wall to the rear wall) has two interior walls that each divide one of the "usual" cavities into two smaller cavities. An orifice, preferably in the form of an elongated slot, is formed in each of these interior walls. In a variant on this embodiment, an interior slot is produced in the partition wall and the other two interior walls are spaced at varying distances from the exterior slots. One sequence of cavities then produces three absorption peaks. In yet another form a solid interior partition wall extends between the side walls and the slotted interior walls extend generally transversely to the partition wall. In still another form, the interior slot is formed in a front-to-rear partition wall within the block to produce a block with only two sequenced cavities.

These and other features and objects of the present invention will be understood more fully from the following detailed description which should be read in light of the accompanying drawings.

DETAILED DESCRIPTION OF THE PREFERRED EMBODIMENTS

Figure 1:
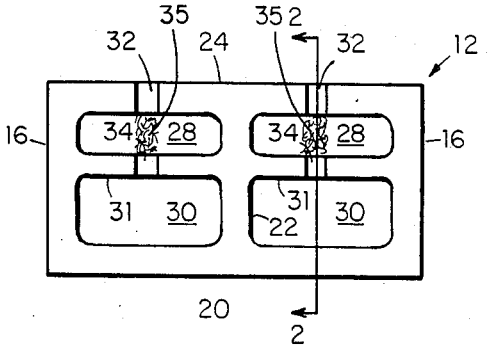
FIG. 1 is a plan view of a masonry block embodying the invention.
Figure 2:
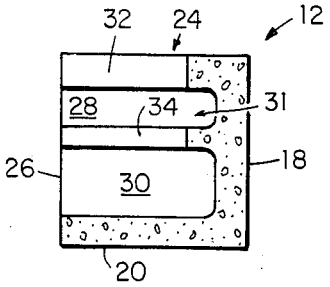
FIG. 2 is a view in vertical section taken along the line 2—2 in FIG. 1.

A sound absorbing, load-bearing masonry block 12 according to a first embodiment of the invention is shown in FIGS. 1 and 2. The block 12 is manufactured using conventional block molding machinery from a hardenable mixture such as concrete. The mixture is packed during manufacture around at least one male plug 14 of the type shown in FIG. 3. Before curing, the mold pieces are stripped. After curing a hardened load-bearing element with the cross section shown in FIGS. 1 and 2 remains. These blocks 12 can be cemented together in courses to form a structure, such as a wall of a building, that dissipates sound energy emanating from a source located on at least one side of the structure. In a modified configuration the blocks 12 can be used to form a ceiling of a building.

The block 12 has a generally rectangular, box-like external configuration with a pair of closed end walls 16,16, a third or top closed wall 18 contiguous with the walls 16, a fourth or back closed wall 20 contiguous with the walls 16 and 18, a continuous, closed partition wall 22, and a fifth or front wall 24 opposite the fourth wall and intended to face the source of sound to be suppressed. A bottom plane 26, opposite the wall 18, is open to interior cavities 28,28 and 30,30 within the block. This opening, of course, is sealed by a top wall 18 of another block and a layer of mortar when the blocks 12 are laid in courses to form structures. The front wall 24 has orifices 32,32 in the form of parallel walled, elongated slots.

The plug 14 has a protrusion **14*a* with tapered sides that produces one of the slots 32, main bodies 14*b* and 14*c*, also with tapered sides, that produce the cavities 28 and 30, and a connecting piece 14*d* similar in configuration and location to the protrusion 14*a* that produces an interior slot 34. The separation between the plug bodies 14*b* and 14*c* forms an interior wall 31 separating the cavities. The "front" cavity 28 is in direct acoustical communication with the "exterior" slot 32. The "rear" cavity 30 is in direct acoustical communication with the "interior" slot 34. The combination of the front cavity 28 and the slot 32, and the slot 34 together with the cavity 30**, each form an acoustical Helmholtz resonator that functions in the manner described in the aforementioned U.S. patents.

The slots 32 each extend in length "vertically" from the bottom plane 26 towards the interior surface of the top wall 28. The width of the slot 32 at the exterior surface of the wall 24, and throughout the depth of the slot, is shown as being substantially constant. However, the slots may be tapered as described in U.S. Pat. Nos. 3,506,089 or 3,837,426. This open ended orifice design, a slot extending to the open plane 26, allows the slots to be formed in a manner that is compatible with conventional block manufacturing techniques.

A principal feature of the present invention is the use of interior dividing walls 31 with the "interior" slots 34. The slots 34 each extend from the bottom plane 26 toward the top wall 18 along a generally vertical direction and are otherwise preferably of the same general construction as the slots 32. As shown, the slots 34 are substantially parallel-walled, although they also could utilize the configurations described in U.S. Pat. Nos. 3,506,089 or 3,837,426. In any event, the slots 34 each provide an acoustical coupling between the cavity 28 and the cavity 30. Also, the rear, air-filled volume 30 and its associated slot 34 form a "second" acoustical Helmholtz resonator, the first resonator being formed by the slot 32 and the front cavity 28. Both resonators use the air sloshing through the slot as the "mass" of the resonator and the air-filled cavity as the "spring". The natural frequency, $f_n$, of any such resonator, is given by the equation $$f_n=(1/2\pi)(k/M)^{\frac{1}{2}} \quad (1)$$

$$\text{where } M=\rho A(L+\Delta L) \quad (2)$$

and the stiffness k of the "spring" is given by $$k=\rho c^2A^2/V. \quad (3)$$

In these equations, $\rho$ is the density of air, c is the velocity of sound in air, A is the cross-sectional area of the orifice (here a slot) facing the incident sound waves, V=the volume of the cavity, L is the depth of the slot in a direction normal to the cross section A, and $\Delta L$ is the additional length of entrained mass of air that interacts functionally with the slot to dissipate sound energy. $\Delta L$ is proportional to $A^{\frac{1}{2}}$.

Substituting equations (2) and (3) in equation (1), peak absorption occurs at a frequency $f_n$ where $$f_n = \frac{c}{2\pi} \frac{A}{V(L+\Delta L)} \frac{1}{2} \quad (4)$$

Thus, for a block with a given wall thickness (and hence L) and a given slot configuration, the natural frequency of the resonator can be varied by changing either the size of the slot (A) or the volume of the cavity (V).

Figure 3:
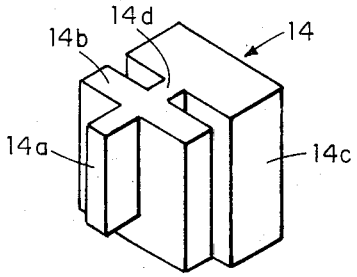
FIG. 3 is a view in perspective of a male mold piece used in the manufacture of the block shown in FIG. 1.
Figure 4:
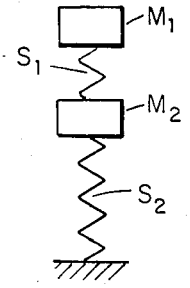
FIG. 4 is a schematic representation of a mechanical spring-mass system analogous to a sequenced, two cavity resonator according to the present invention.

When two such resonators are coupled in series (as are the resonators defined by slot 32 and cavity 28 and the slot 34 and the cavity 30), the system is analogous to a mechanical spring-mass system such as the one shown in FIG. 3. The mass $M_1$ corresponds to the entrained air mass in the first slot 32 and the mass $M_2$ corresponds to the entrained air mass in slot 34. The springs $S_1$ and $S_2$ are analogous to the air-filled cavities 28 and 30. For simplicity of analysis, if one assumes that the slots 32 and 34 are identical (and hence their values of A, L and L are the same), then the natural frequencies of the two resonators, if uncoupled, that is, if they were acting totally independently and not coupled in series, would be $$f_I = \tfrac{1}{2}\pi\sqrt{k_1/M} \qquad (5)$$

$$f_{II} = \tfrac{1}{2}\pi\sqrt{k_2/M}$$

where the subscripts I and II refer, respectively, to the resonances associated with the larger and smaller of the two cavities.

When the resonators are coupled, whether mechanically as shown in FIG. 3 or acoustically by the slot 34 as shown in FIGS. 1 and 2, then the coupled system displays two new natural frequencies $f_a$ and $f_b$ that are different from $f_I$ or $f_{II}$. From known analyses of the analogous mechanical system, it can be shown that:

$$f_a = \left[\frac{f_I^2}{2} + f_{II}^2 - \left(\frac{f_I^4}{4} + f_{II}^4\right)^{\frac{1}{2}}\right]^{\frac{1}{2}} \qquad (6)$$

$$f_b = \left[\frac{f_I^2}{2} + f_{II}^2 + \left(\frac{f_I^4}{4} + f_{II}^4\right)^{\frac{1}{2}}\right]^{\frac{1}{2}}$$

Figure 8:
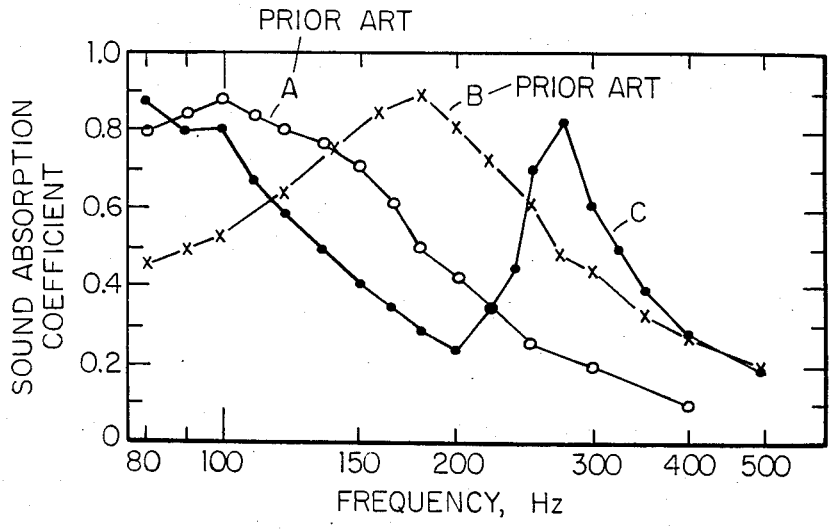
FIG. 8 is a graph of the sound absorption coefficients of three acoustical Helmholtz resonators, two prior art resonators and one sequenced resonator according to the present invention, measured as a function of the frequency of the incident sound energy.

The production of these two natural frequencies due to the coupling is demonstrated further by the following example. For a typical two cavity, 8 inch concrete block (8 inches×8 inches×16 inches), typical values are $V_1=210$ inch$^3$, $V_2=82$ inch$^3$, $L=\frac{3}{4}$ inch, $\Delta L=\frac{1}{2}$ inch, and $A=0.8$ inch$^2$. With these values, from equation (5) we derive $f_I=119$ $H_z$ and $f_{II}=191$ $H_z$. Substituting these values in equation (6) yields $f_a=110$ $H_z$ and $f_b=274$ $H_z$. Relating this discussion to FIG. 1, $V_1$ is cavity 30, $V_2$ is cavity 28, $f_a$ is $f_2$ and $f_b$ is $f_1$. The analysis can be generalized to N natural frequencies $f_a, f_b \ldots f_N$ of N coupled resonators whose uncoupled natural frequencies are $f_I, f_{II}, f_{III} \ldots$ With reference to FIG. 8, the sound absorption coefficient of several acoustical Helmholtz resonators are plotted as a function of the frequency of the incident sound energy. Graph A shows the response of a prior art uncoupled resonator with a large cavity (210 inch$^3$). Graph B shows the response of a prior art uncoupled resonator with a small cavity (82 inch$^3$). Graph C shows the response of these two resonators when coupled in sequence according to the present invention. Graph C demonstrates absorption peaks both in the low frequency range and at the mid frequency range, at approximately 274 $H_z$. These measured values correspond well with the values anticipated by equation (6). In producing these graphs, as shown in FIG. 1 a glass fiber pad 35 was placed within the cavity adjacent the external slot as described in U.S. Pat. No. 2,933,146. This increases the frictional resistance in the slot to the movement of the air mass. However, the frictional resistance must be approximately matched by the acoustic radiation resistance of the slot, which varies as a function of $A^2$. It has been found that slots with comparatively large dimensions (a large value for A) and glass fiber inserts adjacent the slots produce an overall heightening of the sound absorption performance of the block. Also, it tends to broaden the absorption peaks at the natural frequencies.

In any sequence of cavities according to this invention, only the "stiffest" cavity, that is, the one with the smallest volume and the highest natural frequency $f_1$, is exposed to incident sound waves directly. Subsequent cavities are arranged in decreasing order of natural frequency. For any cavity n, with a natural frequency $f_n$, the immediately following cavity n+1 will have a natural frequency $f_{n+1}$, where $f_n > f_{n+1}$. This arrangement avoids the situation where a resonator with a natural frequency $f_n$ isolates following interior resonators from incident sound energy with natural frequencies in excess of $f_n$.

Figure 5:
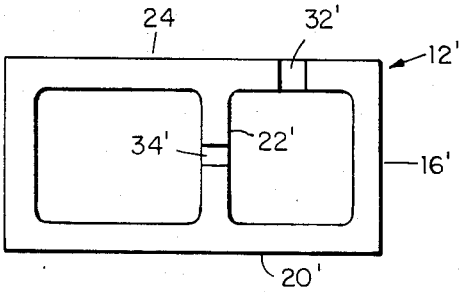
FIG. 5 is a plan view corresponding to FIG. 1 of an alternative embodiment of the invention.

FIG. 5 shows an alternative embodiment of the invention where the block 12' (like parts in different embodiments having the same reference numbers) has only one exterior slot 32 and the partition wall 22 has a slot 34 so that the cavities spaced laterally within a single block are sequenced according to the present invention. The wall 22 therefore functions in the same manner as the interior walls 31 in the FIGS. 1 and 2 embodiment. The front cavity 28 communicates directly with the slot 32 and has a smaller volume than the cavity 30 on the opposite side of the wall 22. As discussed above, this coupling and sequencing of the cavities produces multiple absorption peaks. It should be noted that the partition wall 22' is displaced from the center line of the block 12' to produce cavities of unequal volume. Also, assuming that the exterior dimensions of the block 12' are the same as those of the block 12 in FIGS. 1 and 2, the cavities 28 and 30 can have a comparatively large volume to produce one or two absorption peaks at lower frequencies than would be obtainable with the smaller cavities of FIGS. 1 and 2, other variables such as slot size being the same.

Figure 6:
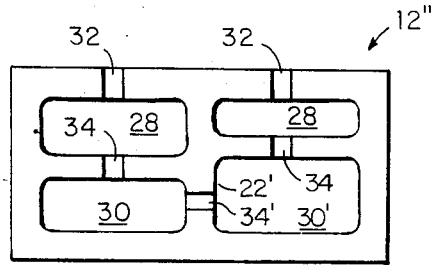
FIG. 6 is a plan view corresponding to FIG. 1 of an alternative embodiment of the invention capable of producing four absorption peaks.

FIG. 6 shows a block 12'' that is a varient of the FIGS. 1 and 2 embodiment. The interior walls 31 are set at different distances from the front wall 24 and there is an additional slot 34' located in the partition wall 22 communicating between the cavities 30 and 30'. As shown, the right hand cavity 30' is larger than the left hand cavity 30. As discussed above, the left hand slot 32 therefore will transmit sound energy to three cavities, the left hand cavities 28 and 30, and the right hand cavity 30'. The right hand slot 32, as shown, will transmit sound energy to only the right hand two cavities 28 and 30'. The additional slot 34' in the wall 22' and the right hand cavity 30' form a third resonator in the left-hand sequence of cavities. This third resonator has a natural frequency $f_3$ that is lower than the natural frequencies of the preceding two resonators. In this embodiment, the right hand cavity 30' is shared by two sequences of cavities as their final cavity. Of course, it is possible to omit the slot 34'. With the interior walls 31 set at different depths, the block 12'' will still produce four absorption peaks.

Figure 7:
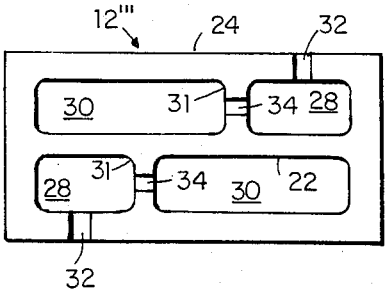
FIG. 7 is a plan view corresponding to FIG. 1 of yet another embodiment of the invention designed to dissipate sound energy originating from opposite sides of the block.

FIG. 7 shows a block 12''' which features a partition wall 22 that extends longitudinally through the block between the end walls 16,16 and a pair of interior walls 31 that extend generally transversely from the front and rear walls to the partition wall. The partition wall 22 is continuous and solid from the top wall 18 to the open bottom plane 26. The interior walls 31 each have a slot 34 that forms a second coupled resonator of the rear volume 30 remote from the front volume 28 and its associated exterior slot 32. A principal advantage of the block 12''' is that one slot 32 is located in each of the front and rear walls 24 and 20, respectively. The block 12''' is therefore capable of receiving and dissipating, at multiple, preselected absorption peaks, sound energy emanating from sources in two separate regions, that is, from both sides of the block. Blocks of this design are particularly useful to construct dividing walls between two regions such as two rooms or two lanes of a depressed highway.

There has been described a load-bearing, sound-absorbing structural block that is capable of producing multiple absorption peaks at preselected frequencies without using metallic septa or other components that must be manufactured separately from the block and then assembled. More specifically, the present invention provides the efficient dissipation of incident sound energy with multiple absorption peaks with the block being manufacturable in a single molding process.

While the invention has been described with respect to its preferred embodiments, it should be understood that various alterations and modifications will occur to those skilled in the art from the foregoing detailed description and the accompanying drawings. For example, while the orifice communicating with an internal cavity has been described herein as an elongated, open ended slot, it is possible to achieve the performance of the present invention with an opening having a different configuration, for example, a slot oriented horizontally, not vertically, or a closed opening within the block wall. These configurations, however, are not as compatible with conventional molding machinery and processes, and therefore are not preferred. Similarly, the invention has been described with reference to parallel walled slots, whereas it may be preferable for a given application to utilize flared wall slots of the type described in U.S. Pat. Nos. 3,506,089 or 3,837,426. These flared wall slots will produce an enhanced energy absorption at higher frequencies than would be obtainable under comparable circumstances with the substantially parallel-walled slot having a width comparable to the throat section of the flared slot. Fibrous fillers may be used as discussed above or as discussed in the U.S. patents mentioned above. It is even possible to use metallic septa such as those described in U.S. Pat. No. 3,866,001 in addition to the sequenced cavities of the present invention in special cases where very many absorption peaks are required and the available interior space of conventional blocks limits the number of interior walls that can be created. These and other modifications and variations are intended to fall within the scope of the appended claims.

What is claimed is:

1. In a sound-absorptive block of molded structural material having a front wall, a rear wall, two end walls, a top wall and an opening opposite said top wall where at least the exterior surface of said front wall receives the sound energy to be absorbed, said walls formed integrally with one another to provide a load bearing capability and defining an interior space, the improvement comprising at least one interior wall that divides said interior space into sequenced cavities including at least a first cavity adjacent said sound receiving wall and a second cavity separated from said first cavity by said interior wall, a first orifice formed in said sound receiving wall, said first orifice and said first cavity forming a first acoustical resonator that dissipates sound energy at a natural frequency $f_1$, and a second orifice formed in said at least one interior wall to couple acoustically said sequenced cavities, wherein said second cavity is coupled to said sound receiving wall only through said first cavity, said second orifice and said second cavity forming a second acoustical resonator that dissipates sound energy at a natural frequency $f_2$, where $f_1 > f_2$.

2. The sound-absorptive block according to claim 1 wherein said first and second orifices are each elongated slots that extend vertically from said opening toward said top wall.

3. The sound-absorptive block according to claim 2 further comprising N of said interior walls each having one of said second elongated slot orifices to form a sequence of N+1 acoustically coupled resonators each with a natural frequency $f_n$, where $f_{n-1} > f_n$, where $n = 1, 2, \ldots N+1$, and where $f_1$ is the natural frequency associated with the resonator using said first orifice.

4. The sound-absorptive block of claim 1 or 2 wherein said block further comprises a continuous partition wall that extends from said opening to said top, front and rear walls positioned and adapted to produce a first sequence of cavities and a second sequence of cavities, and wherein each of said sequence of cavities contain at least one interior wall each with one of said second orifices, said at least one interior wall extending generally transversely to said partitioning wall, and wherein said sound receiving wall contains two of said first orifices each communicating with one of said first cavities in said sequences of cavities.

5. The sound-absorptive block according to claim 4 wherein said partition wall contains one of said second orifices communicating between said second cavities.

6. The sound-absorptive block according to claim 5 wherein said interior walls are located to create second cavities in a first sequence of cavities of unequal volume with second cavities in a second sequence of cavities whereby the natural frequency $f_2$ associated with a second cavity in said first sequence is greater than the natural frequency $f_2'$ associated with a second cavity in said second sequence.

7. The sound-absorptive block according to claim 1 wherein said interior wall extends generally in a direction normal to said sound receiving wall and is laterally offset from the center of said block so that said first cavity has a smaller volume than said second cavity.

8. The sound-absorptive block according to claim 1 further comprising at least one additional interior wall that divides said interior space into sequenced cavities including at least a third cavity adjacent said rear wall and a fourth cavity separated from said third cavity by an interior wall, a third orifice similar to said first orifice and located in said rear wall, said third orifice and said third cavity forming a third acoustical resonator that dissipates sound energy at a natural frequency $f_3$, and a fourth orifice formed in at least one interior wall to couple acoustically said sequence of cavities comprising said third and fourth cavities to said rear wall through said third orifice and third cavity, said fourth orifice and said fourth cavity forming a fourth acoustical resonator that dissipates sound energy at a natural frequency $f_4$, where $f_3 > f_4$.

9. The sound-absorptive block according to claim 8 further comprising a continuous interior wall to partition said sequence of cavities comprising said first and second cavities and said sequence of cavities comprising said third and fourth cavities, said continuous interior wall extending between said open face, said top wall and said end walls, said interior walls extending between said open face, said top wall, said continuous interior wall and said front and rear walls.

10. The sound-absorptive block of claim 1 wherein the size of said orifices and the volume of cavities are selected to tune said natural frequencies, when uncoupled, to desired values according to the formula $f_n = (c/2\pi)(A/V(L+\Delta L)^{\frac{1}{2}}$, where c=the velocity of sound in air, A=the cross-sectional area of the orifice, V=the volume of the cavity associated with that orifice, L=the depth of the orifice in a direction normal to the orifice cross-sectional area A, and $\Delta L$=the additional length of entrained mass of air, which is proportional to $A^{\frac{1}{2}}$.

11. The sound-absorptive block according to claim 10 further comprising a porous sound absorptive material disposed behind at least said first orifice to enhance and broaden the associated sound absorption at the natural frequency $f_1$ of said first resonator.

* * * * *